US005282543A

United States Patent [19]

Picozza et al.

[11] Patent Number: 5,282,543

[45] Date of Patent: Feb. 1, 1994

[54] COVER FOR ARRAY OF REACTION TUBES

[75] Inventors: Enrico Picozza, Newtown; Timothy M. Woudenberg, Bethel; Robert Ragusa, Newtown; Ralph Keese, Trumbull, all of Conn.

[73] Assignee: The Perkin Elmer Corporation, Norwalk, Conn.

[21] Appl. No.: 2,559

[22] Filed: Jan. 11, 1993

Related U.S. Application Data

[63] Continuation-in-part of Ser. No. 871,264, Apr. 20, 1992, which is a continuation-in-part of Ser. No. 620,606, Nov. 29, 1990, abandoned, which is a continuation-in-part of Ser. No. 670,545, Mar. 14, 1991, abandoned.

[51] Int. Cl.[5] ..... B65D 51/18

[52] U.S. Cl. ..... 220/255; 422/99; 435/287

[58] Field of Search ..... 422/99, 102; 435/287, 435/293, 300, 301, 316, 809; 100/211; 220/524, 525, 526, 23.4, 23.83, 255; 428/132, 137, 172

[56] References Cited

U.S. PATENT DOCUMENTS

| | | | |
|---|---|---|---|
| 3,206,017 | 9/1965 | Williams | 220/23.4 |
| 3,302,854 | 2/1967 | Midgley et al. | 220/23.4 |
| 3,366,265 | 1/1968 | Hesselbarth | 220/23.4 |
| 4,392,389 | 7/1983 | Eckstein et al. | 220/23.4 |
| 5,038,852 | 8/1991 | Johnson et al. | 422/116 |
| 5,056,427 | 10/1991 | Sakabe et al. | 100/211 |

FOREIGN PATENT DOCUMENTS 0388159 9/1990 European Pat. Off. .

*Primary Examiner*—Robert J. Warden
*Assistant Examiner*—Theresa A. Trembley
*Attorney, Agent, or Firm*—John R. Wahl; Edwin T. Grimes

[57] ABSTRACT

An array of reaction tube covers adapted to seal a plurality of reaction tubes comprises a unitary body of flexible material having a plurality of flexible plastic nodules. Each nodule is adapted to seal one of the reaction tubes. Each of the nodules is flexible held in a predetermined planar spaced relationship from each other in rows, preferably in rows and columns, by an integral web having a plurality of apertures therethrough. Each of the nodules has a downwardly convex, generally hemispherical lower portion extending from the web, an upwardly convex upper portion extending from the web over the lower portion, and a centrally domed nipple extending upwardly from the upper portion.

18 Claims, 3 Drawing Sheets

COVER FOR ARRAY OF REACTION TUBES

This application is a continuation-in-part of U.S. patent application Ser. No. 07/871,264, filed Apr. 20, 1992, which is a continuation-in-part of U.S. patent application Ser. Nos. 07/620,606, filed Nov. 29, 1990, now abandoned and 07/670,545, filed Mar. 14, 1991, now abandoned, and each of which is incorporated herein by reference.

BACKGROUND OF THE INVENTION

1. Field of the Invention

This invention generally relates to chemical reaction tube covers, and more particularly to a cover for a two-dimensional array of reaction tubes preferably utilized in an instrument for performing polymerase chain reactions (PCR).

2. Description of the Related Art

Automated thermal cyclers for performing PCR simultaneously on a number of samples are disclosed in the patent applications mentioned above and in U.S. Pat. No. 5,038,852. Briefly, PCR is an enzymatic process by which a small amount of specific DNA sequences can be greatly amplified in a relatively short period of time. The method utilizes two oligonucleotide primers that hybridize to opposite strands and flank the region of interest in the target DNA. A repetitive series of thermal cycles involving template denaturation, primer annealing, and the extension of the annealed primers by DNA polymerase results in the exponential accumulation of a specific DNA fragment whose termini are defined by the 5' ends of the primers.

A reaction mixture made up of the target DNA to be amplified, oligonucleotide primers, buffers, nucleotide triphosphates, and preferably a thermostable enzyme such as Taq polymerase, are combined and placed in reaction tubes. The reaction mixture contained in the tubes is then subjected to a number of thermal transition and soak periods known as PCR protocols in a thermal cycler to generate the amplified target DNA.

An array of reaction tubes is typically made up of up to either 48 or 96 tubes arranged in a $6\times8$ array or an $8\times12$ array in a tray. The array of tubes is placed in a metal thermal cycler block so that the lower portion of each tube is in intimate thermal contact with the block. The temperature of the block is then varied in accordance with the predetermined temperature/time profile of the PCR protocol for a predetermined number of cycles.

The denaturation step of the PCR protocol involves heating and maintaining the reaction mixture to around 95° C. to separate double stranded DNA into single strands. At this elevated temperature, evaporation becomes a problem. To prevent evaporation of the tube contents during the PCR process, either a layer of wax or oil is placed on top of the mixture in each tube or a cap is placed on each tube in conjunction with a heated cover.

The caps are preferred over the oil or wax layer because application of such a layer is time consuming, messy, and invites mixture contamination. These caps may be separate individual caps or may be attached integrally to the tube. Alternatively, a series of plastic caps are connected together in linear strips of 8 or 12. Each one of the caps includes a tubular lower portion and an upwardly domed upper portion. The caps are connected together by an integral tab so as to form the strip of caps.

A tray of reaction tubes is typically filled with appropriate sample fluids, and each individual cap in a single strip is inserted into a tube so that the domed portion is up and the tubular portion fits down inside the reaction tube to provide a seal. The caps may be removed by pulling up on one end of the individual cap strip, as the reaction tubes are held within the tray by a retainer. Installation of these conventional caps on the reaction tubes is a relatively tedious and time consuming process requiring specific insertion of the tubular portion of each cap in each individual tube.

The tray of capped reaction tubes is inserted into a thermal cycler block and a heated platen cover is lowered over the block, pressing the domed caps downward to uniformly seat all of the reaction tubes and establish good thermal contact between each tube and the thermal cycler block. The heated platen cover provides a closed environment over the upper portions of the tubes projecting above the thermal cycler block. This heated platen cover is maintained during the thermal cycling protocol at a temperature greater than any of the thermal cycling temperatures so as to preclude vapor condensation within the upper portion of the tube or beneath the cap, both of which protrude above the body of the thermal cycler block. Thus, evaporative losses are prevented by the caps and internal vapor condensation is prevented by the elevated temperature under the platen cover.

The heated platen cover also prevents refluxing which affects the temperature of the sample within the reaction tube. Refluxing is the cyclical evaporation and condensation within the enclosed space above the sample within the reaction tube. Refluxing will generally lower the sample temperature during the thermal cycling protocol.

After the thermal cycling protocol has been completed, the tray of capped reaction tubes is removed from the thermal cycler and may be allowed to return to room temperature. The strips of caps are then removed from the tubes carefully so as to preclude cross-contamination between the tubes, and the array is transferred to other instruments for PCR product detection or further processing.

The configuration of plastic caps consisting of a strip of individual domed caps is quite adequate for small scale PCR where high throughputs are not required. The design offers the advantage of isolating each individual reaction tube but can be tedious to position in place and to remove. Accordingly, there is a need for a full plate cover or blanket which would offer the user an easier and faster way of sealing an entire array of tubes and easier, more efficient access to the tubes at the end of the PCR process.

SUMMARY OF THE INVENTION

The cover in accordance with the present invention is a planar array of reaction tube covers which are adapted to seal a plurality of reaction tubes arranged in a predetermined spatial arrangement. In its simplest form, the cover in accordance with the present invention is a flat sheet of flexible plastic material having a plurality of spaced apertures therethrough, forming between the apertures an array of cover portions, one for each of the reaction tubes in a predetermined spatial arrangement. This flat sheet cover is placed on top of the planar array of reaction tubes such that the apertures are positioned between the tubes and the cover portions over the individual tube tops. A heated platen is then lowered onto the cover over the reaction tubes, pressing the cover and the tubes into firm contact with the thermal cycler block, and the PCR process is performed. When the heated platen is removed, the cover is simply lifted off of the reaction tube array in a single motion requiring minimal time expenditure.

This simplest form of the cover of the invention provides a single top seal around the upper lip of each of the reaction tubes. The apertures between the cover portions in the cover permit heated air to circulate between the tubes and from the heated platen downward toward the thermal cycler block to prevent vapor condensation within the portions of the reaction tubes extending above the thermal cycler block.

A second, more preferred, embodiment comprises a sheet cover wherein the cover portions are flexible plastic nodules held in a predetermined spaced relationship from each other by a web. Each of the nodules is adapted to fit into and provide two seals on the mouth of a reaction tube. Each of the nodules has a downwardly convex lower portion and an upwardly convex upper portion directly over the lower portion. The web connecting each of the nodules has a plurality of apertures through the web spaced between the nodules to allow for thermal circulation below and above the cover.

Where the spaced relationship is a planar array utilized to cover a two-dimensional rectangular array of reaction tubes held in a rectangular tray, the nodules are aligned in spaced linear rows and columns, with the apertures preferably diagonally between the nodules. The apertures between the nodules permit air to circulate between the heated platen and the upper sides of the reaction tubes extending above the thermal cycler block.

Each nodule has outwardly convex upper and lower portions extending from the plane of a central sheet or web. The lower portion of each of the nodules is preferably of a hemispherical shape which has a diameter equal to or slightly greater than the inside diameter of the mouth of the reaction tube. This hemispherical shape permits each of the nodules to fit into and concentrically seal one of the tubes in two ways. First, the hemispherical portion fits down into the tube so that there is an annular seal around the inside surface of the tube adjacent the mouth. Second, the portion of the web around the outer perimeter or base of the hemispherical lower portion provides an annular planar seal against the top surface of the mouth of the tube.

The upper portion of the nodule is outwardly convex and preferably has a central nipple extending upward from the upwardly convex portion. This nipple may be in the form of a cylindrical post, or, more preferably, a smooth, curved, domeshaped protrusion extending vertically above the convex upper portion.

Tests utilizing covers in accordance with the present invention in a Perkin-Elmer GeneAmp- PCR System thermal cycler produce the same PCR results as tubes with the conventional individual cap strips discussed above without evidencing sample degradation. The covers of the invention maintain an effective seal on the tubes to prevent any liquid or vapor leakage. The nipple on the upper portion of the nodules does not stick to the heated platen cover and provides efficient downward force transfer to ensure that all of the reaction tubes are firmly seated within the thermal cycler block.

These, and other advantages and features of the invention will become more apparent from a detailed reading of the following description when taken in conjunction with the appended claims.

DETAILED DESCRIPTION OF THE INVENTION

Figure 1:
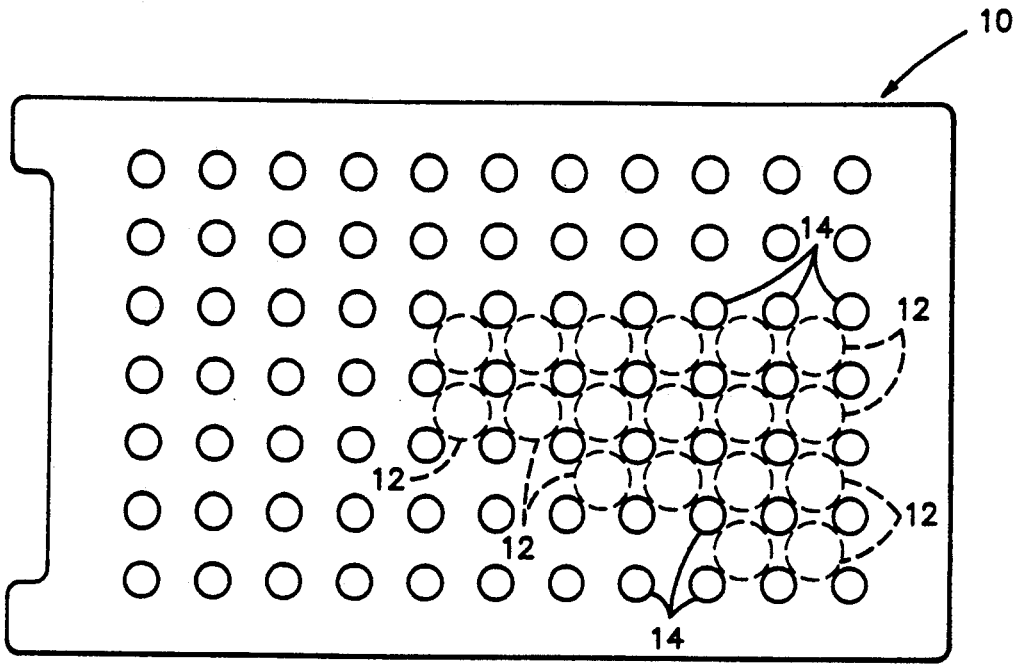
FIG. 1 is a top view of a cover in accordance with a first embodiment of the present invention.
Figure 2:
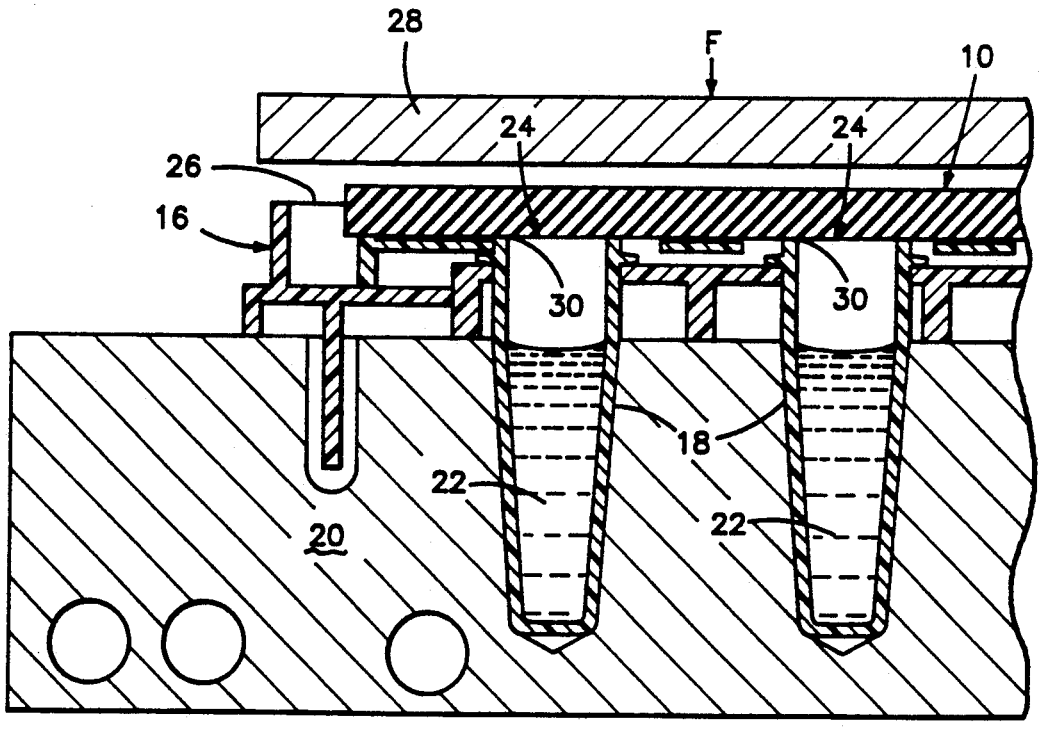
FIG. 2 is a partial sectional view of a thermal cycler and reaction tube tray with the cover shown in FIG. 1 installed on the reaction tubes.

A first embodiment of the cover in accordance with the present invention is shown in a top view in FIG. 1, and installed on an array of reaction tubes placed in a thermal cycler block in FIG. 2. Cover 10 is a flexible sheet of preferably silicone rubber which comprises a planar array of reaction tube cover portions 12 arranged in a predetermined rectangular spatial arrangement corresponding to the centers of a corresponding planar array of reaction tubes held in a tray. A representative number of the cover portions are shown in FIG. 1 in dashed lines. Interspersed between the cover portions 12 are a plurality of apertures 14.

FIG. 2 illustrates a partial sectional view through a thermal cycler containing a tray 16 of reaction tubes 18 which extend into the thermal cycler block 20. Each of the tubes 18 contains a reaction mixture 22 up to a level preferably no higher than the upper surface of the thermal cycler block 20 and has an open mouth 24.

Cover 10 has a thickness that is slightly greater than the distance between the mouth 24 of the tubes 18 and the upper surface 26 of the tray assembly 16. Thus, as a heated platen 28 is lowered onto the upper surface of the tray assembly 16, the cover 10 presses downward against the tops of the reaction tubes 18, pressing them into firm contact with the thermal cycler block 20. At the same time, cover 10 provides a seal over the mouth 24 of each of the tubes 18 by pressing, against the annular upper surface 30 of the mouth 24 of each tube 18.

The heated platen 28 is designed to heat the air around the portion of the reaction tubes 18 that extends above the block 30 to prevent vapor condensation in the upper portion of the tubes. Since the silicone rubber cover 10 is a thermal barrier, apertures 14 are critical to providing circulation of the air beneath the heated platen 28. When the heated platen rests against the upper edge of the tray 16, the captive air space is quickly heated and maintained at a temperature greater than that of the thermal cycler block through radiation and convective heat transfer through the apertures 14. Thus, the cover 10 in accordance with the first embodiment of the invention provides a single annular seal around the mouth of each tube in the array. The thickness of the cover 10 must be enough to protrude above the upper edge 26 of the tray 16. However, the thickness should not be so great as to reduce the heat transfer through the silicone rubber cover inside the annular sealed portion so as to prevent vapor condensation on the under side of the cover portions. A thickness of about ⅛th inch greater than the distance between the tube mouth 24 and the upper surface 26 of the tray 16 is believed to be about optimum.

For a typical 8×12 array of reaction tubes on 9 millimeter centers, the apertures should preferably have a diameter of approximately 4 millimeters. The thickness of the cover should be as thin as possible while still providing an adequate thickness to provide an adequate seal for each tube in the array when the platen cover is lowered.

The flexible plastic sheet material is preferably silicone rubber. However, any flexible plastic material having a high temperature withstand capability and a durometer range between 35 and 65 durometer, and preferably about a 50 durometer silicone rubber, is preferred. This type of material has a long life at high temperature. The sheet material has a thermal conductivity of at least 0.001 W/cm·°K and preferably is within a range of 0.002 to 0.004 W/cm-OK which prevents condensation on the underside of the cover exposed to the reaction tube contents, and is compatible with the PCR process.

Figure 3:
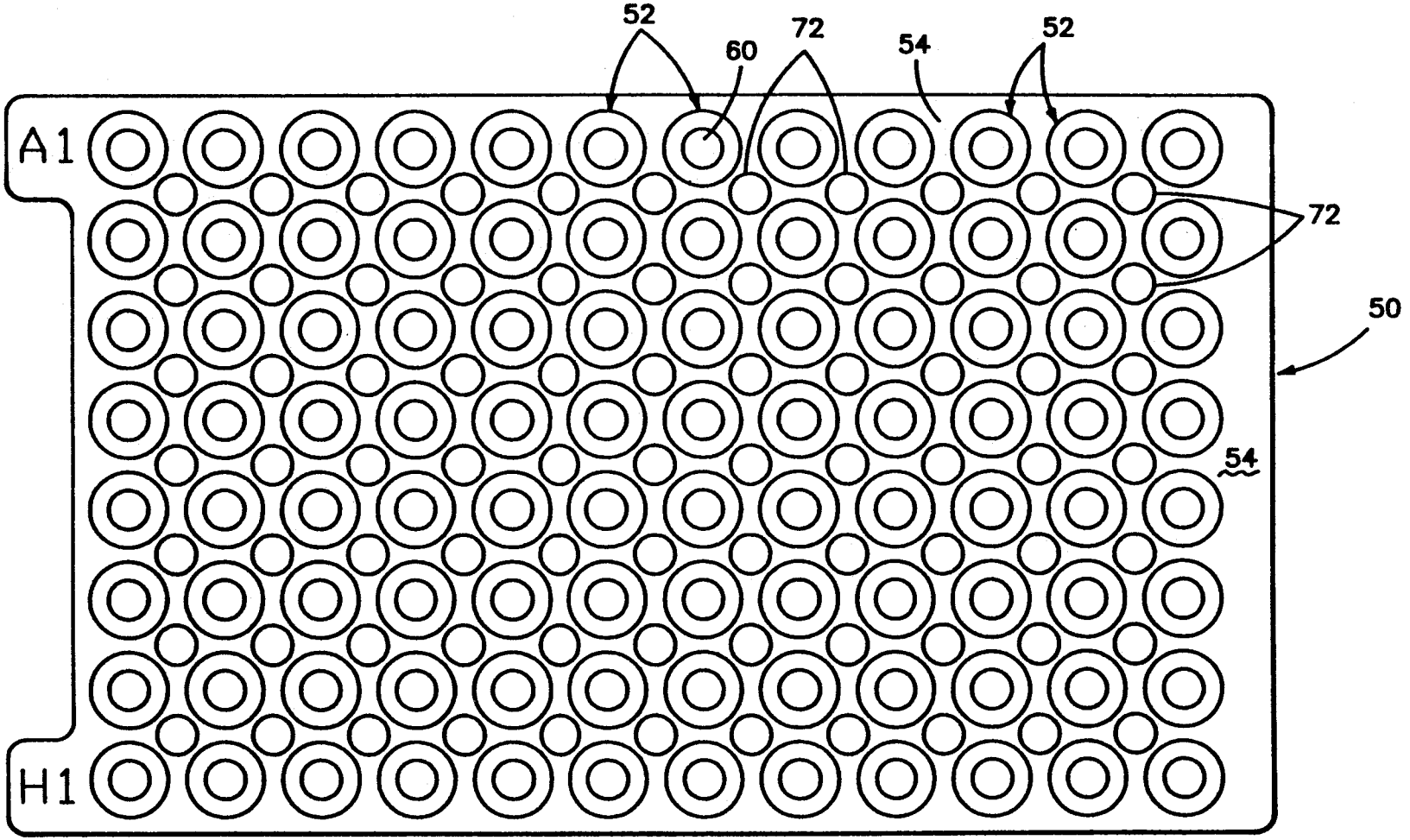
FIG. 3 is a top view of a cover in accordance with a second embodiment of the present invention.
Figure 4:
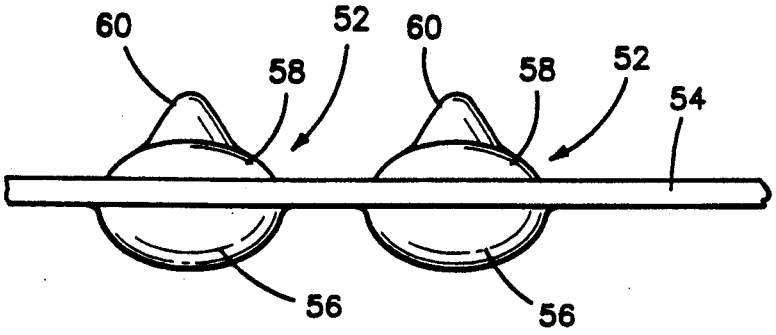
FIG. 4 is an enlarged side view of a portion of the second embodiment of the present invention shown in FIG. 3.

A second embodiment of the cover in accordance with the present invention is shown in a top view in FIG. 3, and a partial side view in FIG. 4. Cover 50 is a planar array of individual reaction tube covers or nodules 52 arranged in a predetermined rectangular spatial arrangement corresponding to the centers of a corresponding planar array of reaction tubes held in a trily. Each of the individual covers or nodules 52 is made of a flexible plastic material and held in the predetermined spaced relationship from each other by an integral web 54. Web 54 may be integral with nodules 52 and made of the same material or may be made of a different material with the nodules 52 molded or adhesively attached to the web 54 at appropriate locations.

As best shown in FIG. 4, each of the nodules 52 preferably has a downwardly convex, e.g. dome-shaped, lower portion 56, though other surface shapes may be used. Nodule 52 has an upwardly convex upper portion 58 over the lower portion 56. Extending upward from the upper portion 58 is an integral nipple 60. The nipple 60 may be a generally rounded conical protrusion as illustrated in FIG. 4, or may be a cylindrical post with a rounded tip. The purpose of the rounded tip on the nipple 60 is to preclude the nipple from adhering to the under surface 62 of the heated platen 64 illustrated in FIG. 5 when the heated platen 64 is lowered with force F onto the cover 50.

Figure 5:
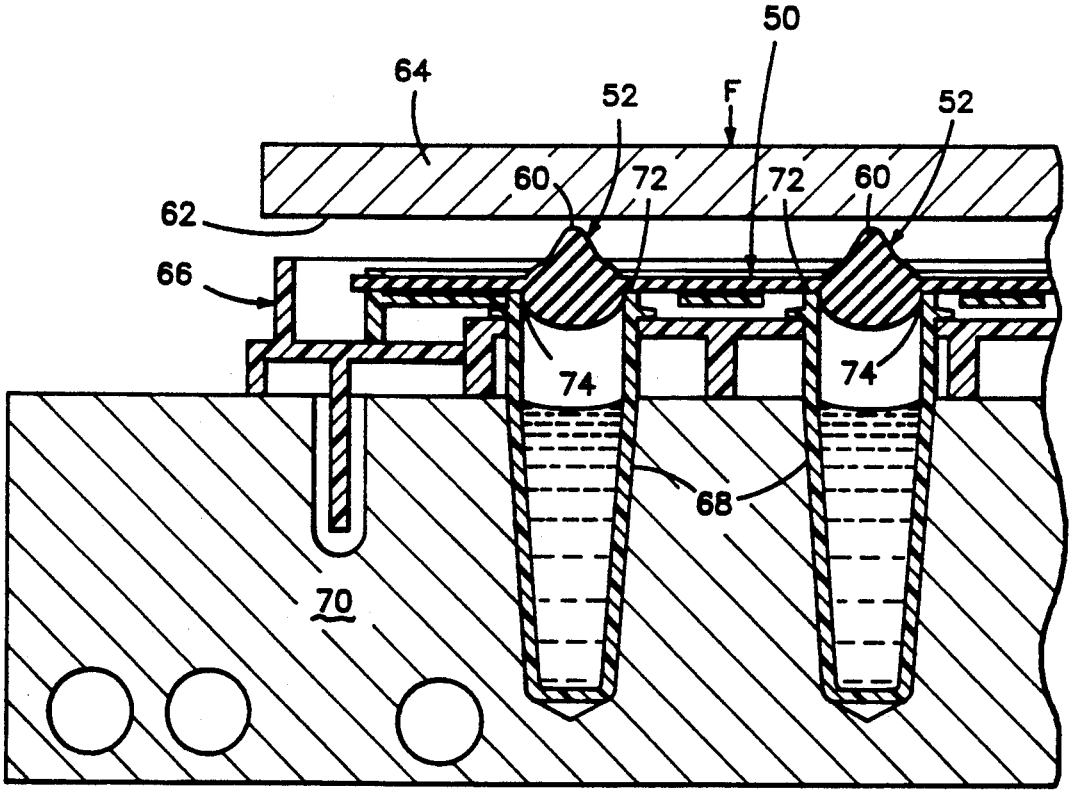
FIG. 5 is a partial sectional view of a thermal cycler assembly and reaction tube tray using the cover in accordance with the second embodiment of the present invention.

FIG. 5 illustrates a partial sectional view through a thermal cycler containing a tray 66 of reaction tubes 68 extending into a thermal cycler block 70. As a heated platen 64 is lowered onto tray 66, nipples 60 are pressed downwardly to seat into and seal each of the tubes 68, and in turn press the tubes 68 into firm contact in thermal cycler block 70.

The rounded upper tip of the nipples 60 is preferred to preclude a suction occurring against the underside 62 of the heated platen 64 as it is removed from engagement with the tray 66 following completion of the PCR protocol. This prevents the cover 52 from being inadvertently lifted with the platen 64.

The heated platen 64 is designed to heat the air around the portion of the reaction tubes 68 that extends above block 70 to prevent vapor condensation in the upper portion of the tubes 68. Apertures 72 are provided between the rows and columns of nodules 52 as the silicone rubber cover, in accordance with the present invention, is a thermal insulator. These apertures permit radiative heat transfer and convective circulation of the air beneath the heated platen 64 and above the upper surface of the block 70. Thus, as the heated platen 64 rests against the upper edge of the tray 66, a captive air space in between is created which is quickly heated and maintained at a temperature greater than the block 70 temperature.

The second embodiment of the cover in accordance with the present invention provides two separate seals on each reaction tube. The first is between the upper surface 72 of the mouth of the tube 68 and the portion of the web 54 around the base of the nodule 52. The second is between an annular portion of the hemispherical lower portion 56 and against the inside surface 74 around the mouth of the reaction tube 68. In another embodiment, this second seal may be provided by a cylindrical extension of the convex lower portion so as to provide a larger contact surface for the seal.

When the force F is removed from the heated platen 64 and the platen raised so that the tray 66 can be removed, the cover 50 remains in place on the array of tubes 68. The entire array of tubes 68 may be uncapped simply by lifting the cover 10 in one motion. Thus, installing and removing the covers is a simple step requiring minimum time while ensuring adequate sealing, minimizing operating time and thus providing a cost savings per analysis.

The cover portion 12 or nodules 50 are spaced on 9 millimeter centers corresponding to the standard array of 96 reaction tubes. The apertures are about 4 millimeters in diameter. It is to be understood that other spacings and sizes may be utilized depending on the reaction tube tray design. The preferred silicon rubber must be chemically resistant to dilute nitric acid, dilute sodium hydroxide, sodium hypochlorite (bleach) , and ethanol having material hardness of Shore A 50, and must be autoclavable. Silicone rubber is preferable in this application as it is inert to the PCR products and reagents, is autoclavable, and is washable in a hypochlorite solution without substantial deleterious effects. A suitable silicone rubber material may be obtained by High Tech Rubber Company, Anaheim, CA.

Other materials may also be utilized provided they are flexible, inert to reactions with the reagents utilized, and can withstand repeated thermal cycling to temperatures above 100° C. Also, the nodules may each have an internal filling of a high thermal conductivity material such as a metal "B-B" to increase the overall heat transfer through the nodules from the heated platen. The covers 10 and 50 in accordance with the present invention need not be utilized with a full tray of reaction tubes. For example, an array of 8 rows by 12 columns, totalling 96 tubes, may effectively be utilized with the cover in accordance with the present invention. However, the same sample tray containing any number of tubes will be adequately sealed with either of the covers in accordance with the present invention. Thus, the covers in accordance with the present invention can effectively replace the conventional cap strips and result in substantial time savings during handling.

All of the embodiments of the cover provide a good hermetic seal on each of the tubes and prevents any leakage, operate so that the tubes may still remain oil free, are easy to remove from the plate and do not stick to the heated platen. While the invention has been described above with reference to a specific embodiment thereof, it is apparent that many changes, modifications, and variations can be made without departing from the inventive concept disclosed herein. For example, the illustrated embodiments of the covers 10 and 50 are rectangular arrays. The array may be a circular, other polygonal, or an annular arrangement, depending on the tray configuration. In addition, the apertures may be placed between linearly adjacent nodules or diagonally between them as shown in FIGS. 1 and 3. In addition, the holes need not be circular. They may also be slots or other designs so long as the cover portions are connected together. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A planar array of reaction tube covers adapted to seal a plurality of reaction tubes arranged in a predetermined special arrangement, said planar array comprising:

a plurality of nodules held in a predetermined spaced relationship from each other by a web, each of said nodules being capable of fitting into and sealing an open end of one of a plurality of reaction tubes, each of said nodules having a lower portion for fitting within said open end and an upwardly convex upper portion directly above said lower portion.

2. The planar array according to claim 1 wherein said lower and upwardly convex portions are integrally connected to said web.

3. The planar array according to claim 1 wherein said web has a plurality of apertures therethrough spaced between said plurality of nodules.

4. The planar array according to claim 1 wherein said array is a molded unitary rubber body.

5. The planar array according to claim 4 wherein said molded unitary rubber body is silicon rubber.

6. The planar array according to claim 1 wherein said lower portion has a solid generally hemispherical shape.

7. A planar array of reaction tube covers adapted to seal a plurality of reaction tubes arranged in a predetermined spacial arrangement, said planar array comprising:

a plurality of flexible plastic nodules connected in a predetermined spaced relationship from each other by a web, each of said nodules being capable of fitting into and sealing an open end of one of a plurality of reaction tubes, each of said flexible plastic nodules having a downwardly convex lower portion, an upwardly convex upper portion directly above said downwardly convex lower portion, and a nipple extending upward from said upwardly convex upper portion.

8. The planar array according to claim 7 wherein said array is a molded unitary body made of silicone rubber.

9. The planar array according to claim 8 wherein said nipple is centered above said upwardly convex upper and downwardly convex lower portions and has a dome shape.

10. The planar array according to claim 9 wherein said web has a plurality of apertures therethrough spaced between said plurality of flexible plastic nodules.

11. The planar array according to claim 7 wherein said downwardly convex lower portion has a generally hemispherical shape.

12. An array of reaction tube covers adapted to seal a plurality of reaction tubes comprising: a unitary body having a plurality of flexible plastic nodules, each adapted to seal one of a plurality of reaction tubes, each of said flexible plastic nodules being flexibly held in a predetermined planar spaced relationship from each other in rows and columns by an integral web having a plurality of apertures therethrough, each of said nodules having a downwardly convex generally hemispherical lower portion extending from said web, an upwardly convex upper portion extending from said web directly above said downwardly convex generally hemispherical lower portion, and a centrally domed nipple extending upward from said upwardly convex upper portion.

13. A planar array of reaction tube covers adapted to seal a plurality of reaction tubes arranged in a predetermined special arrangement, said planar array comprising:

a plurality of nodules held in a predetermined spaced relationship from each other by a web, each of said nodules being capable of fitting into and sealing an open end of one of a plurality of reaction tubes, each of said nodules having a lower portion for fitting within said open end and an upwardly extending upper portion directly above said lower portion.

14. The planar array according to claim 13 wherein said lower and upper portions are integrally connected to said web.

15. The planar array according to claim 13 wherein said web has a plurality of apertures therethrough spaced between said plurality of nodules.

16. The planar array according to claim 13 wherein said array is a molded unitary rubber body.

17. The planar array according to claim 16 wherein said molded unitary rubber body is silicone rubber.

18. The planar array according to claim 13 wherein said lower portion has a solid generally hemispherical shape.

* * * * *